US006779200B1

(12) United States Patent
Shah

(10) Patent No.: US 6,779,200 B1
(45) **Date of Patent: *Aug. 24, 2004**

(54) SUPPORT PADDING FOR USE ON A HUMAN JOINT

(76) Inventor: Mrugesh K. Shah, 403 Trails Ct., Houston, TX (US) 77024

( * ) Notice: Subject to any disclaimer, the term of this patent is extended or adjusted under 35 U.S.C. 154(b) by 136 days.

This patent is subject to a terminal disclaimer.

(21) Appl. No.: 10/162,338

(22) Filed: Jun. 5, 2002

Related U.S. Application Data

(63) Continuation-in-part of application No. 09/963,437, filed on Sep. 27, 2001, now Pat. No. 6,446,267.

(51) Int. Cl.[7] ..... A41D 13/00
(52) U.S. Cl. ..... 2/242
(58) Field of Search ..... 2/242, 455, 24, 2/22, 267, 62, 16, 911, 69, 459, 239, 129, 159, 167, 168; 128/878, 881, 882; 602/20, 21, 23, 26, 27, 61–63

(56) References Cited

U.S. PATENT DOCUMENTS 573,919 A * 12/1896 Rice ..... 2/24
1,296,113 A * 3/1919 Perlman ..... 2/2.5
1,560,825 A * 11/1925 Kelticka ..... 2/24
4,213,202 A * 7/1980 Larry ..... 2/456
4,642,814 A * 2/1987 Godfrey ..... 2/462
5,042,175 A * 8/1991 Ronen et al. ..... 36/28
5,735,807 A * 4/1998 Cropper ..... 602/63
5,881,395 A * 3/1999 Donzis ..... 2/455
6,131,196 A * 10/2000 Vallion ..... 2/24
6,446,267 B1 * 9/2002 Shah ..... 2/239

* cited by examiner

*Primary Examiner*—Tejash Patel
(74) *Attorney, Agent, or Firm*—Harrison & Egbert

(57) ABSTRACT

A support padding for use on a human joint including an outer layer having a shape conforming to the shape of the human joint, a resilient member layer positioned adjacent to the outer layer and extending around an interior of the outer layer, a packing layer positioned adjacent to the resilient member layer and extending around an interior of the resilient member layer, and an interior layer affixed to the packing layer so as to define a cavity for receiving the human joint therein. The human joint can be either a shoulder, an ankle, a knee, a spine or a neck. A deformable member can be affixed to the packing layer opposite the resilient member layer for conforming to a contour of the human joint upon pressure applied to the surface of the human joint thereto.

20 Claims, 4 Drawing Sheets

SUPPORT PADDING FOR USE ON A HUMAN JOINT

RELATED U.S. APPLICATIONS

The present application is a continuation-in-part of the U.S. patent application Ser. No. 09/963,437, filed on Sep. 27, 2001, now U.S. Pat. No. 6,446,267 and entitled "Protective Sock and Shoe Lining", presently.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to support padding. More particularly, the present invention relates to support padding for use on human joints. Additionally, the present invention relates to support padding which will absorb shock and pressure applied thereto during human activity. Additionally, the present invention relates to support padding for human joint which will provide a suitable jog of movement upon application of pressures thereto.

BACKGROUND OF THE INVENTION

As is well known, the joints of the human body help to facilitate the movement of the entire body. The joints of the human body can include elbows, shoulders, ankles, knees, the neck and the spine. There are many support pads presently on the market which absorb a portion of the shock imparted to such joints during normal human activity. Any shocks that are not properly absorbed can cause damage to the joints, and the associated human body structure. This is particularly true of the feet, which have many bones and many jointed surfaces, and the knees which have fine meniscus stabilizing the joint and permitting smooth movement. The spinal cord is built for many vertebrae which disks between them are very sensitive to changes, and which permit bending and straightening of the body.

Over a long period of athletic activity, the beating and shocks imparted to the joints of the human body can often cause stress fractures in the bone structure adjacent to such joints. Also, these shocks can often cause changes in the structure of the vertebrae, affecting the disks between them, by making them thin and irregular due to friction, so that they lose their flexibility. The damage caused to the skeletal structure of the human body by impact to the various joints can lead to neck and shoulder pain, poor blood circulation and stability problems.

During athletic activity, such as during the play of football, great pressures and stresses are applied to the various human joints. When the structures associated with the clothing and padding at such joints do not overcome the pressures applied thereto, damage can occur. Often, the strong torques applied by the joints during such activity can cause inherent and long term damage to such joints. As such, there is a need to provide an improved system of shock absorption which is user specific and preserves the maximum amount of energy accumulation during suppression of material from which the support pad is constructed.

In the past, various U.S. patents have issued in the past relating to such support padding. For example, U.S. Pat. No. 3,760,056, issued on Dec. 18, 1973 to M. F. Rudy, describes a method of custom fitting an inflatable bladder to a wearer's foot. The inflatable bladder is made of a suitable elastomer which may be heated, distended and then cooled at room temperature to set the bladder in the distended shape. The bladder will custom fit to the wearer's foot.

U.S. Pat. No. 3,765,422, issued on Oct. 16, 1973 to H. M. Smith, describes a fluid cushioned podiatrac insole. This insole is in the form of a flat flexible envelope in the outline of a wearer's foot. The envelope contains a liquid or semi-liquid flowable cushioning medium. A transverse wall divides the interior of the insole into front and rear chambers. The transverse wall extends along the forward edge of the metatarsal pressure points of the foot of the wearer. The rear chamber has longitudinal walls directing the flowable medium forwardly and rearwardly in such chamber.

U.S. Pat. No. 5,067,257, issued on Nov. 26, 1991 to S. Coomer, describes an injection fitted boot liner which is fitted by low pressure fluid injection over the wearer's anatomy. This liner is formed by permeation of select areas of porous padding, surrounding areas of non-porous padding and with scarfed abutment of padding for gradual softness variation. An impervious membrane occluding portions of the porous padding is used to control fluid resin penetration.

U.S. Pat. No. 5,392,534, issued on Feb. 28, 1995 to T. E. Grim, teaches a vacuum formed comfortable sole which uses vacuum formable bladders in the sole of the shoes or in the sides of the upper portions of the shoes. The bladders are filled with material, such as small spherical particles, which retain a configuration conforming to the shape of the feet under reduced pressure conditions.

U.S. Pat. No. 5,042,175, issued on Aug. 27, 1991 to Rowen et al., teaches a user-specific shoe sole coil spring system having a layout of individual coil springs which are seated in a shoe sole having prefabricated circular depressions. The coil spring system has stiffness characteristics which are customized to serve the needs of different users and different applications. The system provides shock absorption distribution patterns and energy return patterns for the shoe sole to fit the requirements of the particular application. The sole has a cover strip overlaying the coil spring system which is openable and reclosable for allowing changes in the layout, as required.

U.S. Pat. No. 5,575,090, issued on Nov. 19, 1996 to A. Condini, teaches an inner boot tongue of a ski boot which has an outer part formed of an impermeable semi-rigid plastic having an alveolate structure and which is covered directly by a foam-type padding and by a woven or knitted liner. The air contained in the alveoles of the alveolate structure forms a particularly effective damper cushion in dynamic compression.

U.S. Pat. No. 5,647,149, issued on Jul. 15, 1997 to M. W. Dalebout, describes a sport boot system incorporating a pliable inner liner within a rigid outer shell. The inner liner is of a foam material and is provided with a single bifurcation at its outer side to provide a tongueless entry access opening. Relief structures are positioned at the front of the liner to provide enhanced forward flexibility and to increase comfort.

It is an object of the present invention to provide a support padding which has maximum shock-absorption characteristics.

It is another object of the present invention to provide a support padding which provides suitable "give" so as to prevent damaging torques from adversely affecting the skeletal structure of the human body.

It is a further object of the present invention to provide a support padding for human joint which cushions against shocks and impacts occurring during normal human activity.

It is still a further object of the present invention to provide a support padding which is comfortable and easy to use.

These and other objects and advantages of the present invention will become apparent from a reading of the attached specification and appended claims.

BRIEF SUMMARY OF THE INVENTION

The present invention is a support padding for use on a human joint comprising an outer layer having a shape generally conforming to the shape of the human joint, a resilient member layer positioned adjacent to the outer layer and extending around the interior of the outer layer, a packing layer positioned adjacent to the resilient member layer and extending around an interior of the resilient member layer, and an inner layer affixed to the packing layer and having a cavity for receiving a human joint therein. The resilient member comprises a plurality of springs each having one end secured to the outer layer.

In the present invention, the outer layer is of a fibrous material. A deformable member is in affixed to the packing layer opposite to the resilient member layer. This deformable member conforms to a contour of the human joint upon pressure applied by a surface of the human joint thereto. A flexible structure is interposed between the packing layer and the resilient member layer. The plurality of springs each have an opposite end secured to this flexible structure.

In the present invention, the human joint can be an elbow, a shoulder, a knee, an ankle, a neck or a spine. The outer layer will have a shape conforming to the exterior surface of the respective human joint. When the human joint is a shoulder, a strap extends in a loop outwardly of the outer layer so as-to have a size suitable for extending around a human torso. When the human joint is a knee, the various layers will be generally elastic so as to extend around the knee in compressive relationship therewith. When the human joint is a spine, a closure means is affixed to the layer for releasably securing the layers around the human body adjacent to the spine.

In the present invention, the packing layer can be a material selected from the group consisting of bubble wrap material and foam material. The foam material will be a plurality of foam elements arranged in a random pattern around the interior of resilient member layer. The deformable member can include a plurality of silicone pads affixed to an interior surface of the packing layer. The inner layer is formed of a fibrous material.

DETAILED DESCRIPTION OF THE INVENTION

Figure 1:
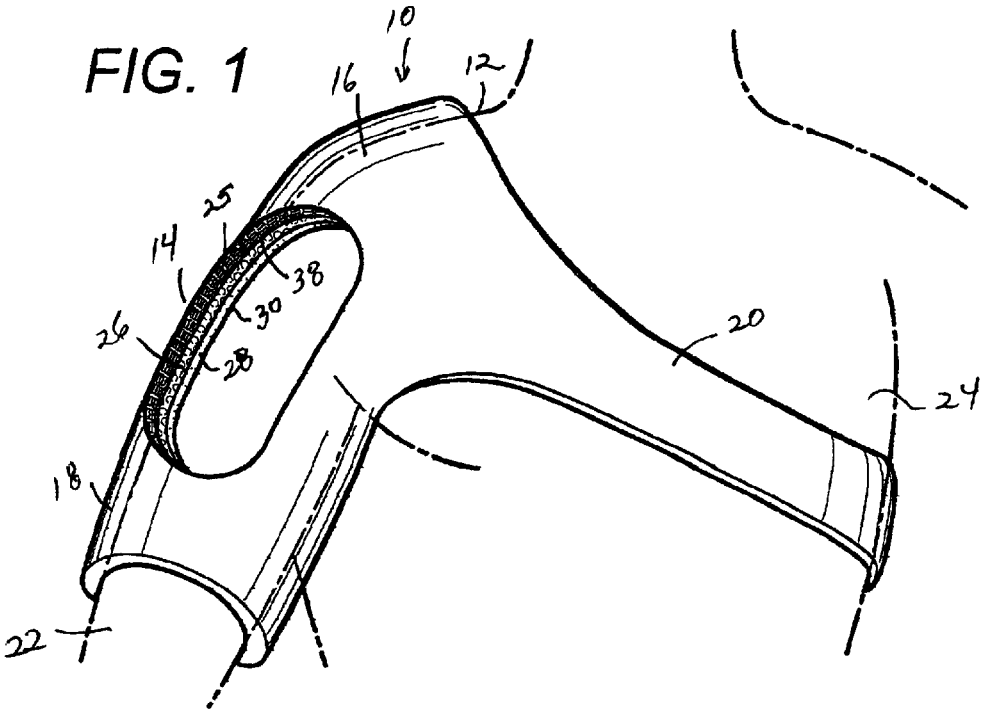
FIG. 1 shows a cut-away perspective view of the support pad of the present invention as applied to a human shoulder.

Referring to FIG. 1, there is shown a shoulder pad 10 of the present invention as applied to a human shoulder 12. Shoulder pad 10 is illustrated as having an outer layer 14 generally conforming to a shape of the human shoulder 12. The shoulder pad 10 includes an upper shoulder portion 16, an arm-encircling portion 18 and a strap 20. The shoulder pad 10 of the present invention has an interior cavity suitable for receiving the human shoulder 12 therein. The arm-encircling portion 18 will extend downwardly along the arm 22 below the shoulder 12. The strap 20 will wrap around the human torso 24 so as to secure the shoulder pad 10 in a desired position.

A cross-sectional view of the various layers of the present invention is shown in FIG. 1. In FIG. 1, it can be seen that the outer layer 14 generally conforms to the cross-sectional shape of the shoulder 12. A resilient member layer 25 is positioned adjacent to the outer layer 14 and extends around the interior of the outer layer 14. A packing layer 26 is positioned adjacent to the resilient member layer 25 and extends around an interior of such resilient member layer 25. A deformable member layer 28 is affixed to the interior surface of the packing layer 26. Deformable member layer 26 is positioned to be directly adjacent to the outer surface of the shoulder 12. If necessary, inner layer 30 can extend around the deformable member layer 28 and directly against the outer surface of the human shoulder 12.

As can be seen herein, the outer layer 14 is formed of a fibrous material, such as cotton. The resilient member layer 25 comprises a plurality of springs each having one end secured to the outer layer 14 and an opposite end secured to the packing layer 26. Tis plurality of springs extend against a surface of the packing layer 26. A flexible structure 38 may be provided between the packing layer 26 and the resilient member layer 25 so as to provide a structure whereby each of the springs can be directly secured thereto. Each of the springs will have a longitudinal axis which extends transverse to the longitudinal axis of the shoulder 12. When forces are applied by the shoulder 12 against the resilient member layer 25, each of the springs will extend and/or compress depending upon the amount of force that is applied by the shoulder 12 to an interior surface of the shoulder pad 10.

The packing layer 26 is either a bubble wrap material or a foam material. The packing layer 26 extends around the interior surface of the resilient member layer 25. When a foam material is used, the packing layer 26 can be a plurality of foam elements arranged in a random pattern around the interior surface of the resilient member layer 25.

The deformable member layer 28 includes a plurality of silicone pads affixed to the interior surface of the packing layer 26. The silicone pads associated with the deformable member layer 28 are suitably conformable so as to provide a more gradual conforming of the shoulder pad 10 to the contours of the human shoulder 12. Within the concept of the present invention, various silicone pads can be used as part of the deformable member layer 28 throughout the interior surface of the shoulder pad 10.

Figure 2:
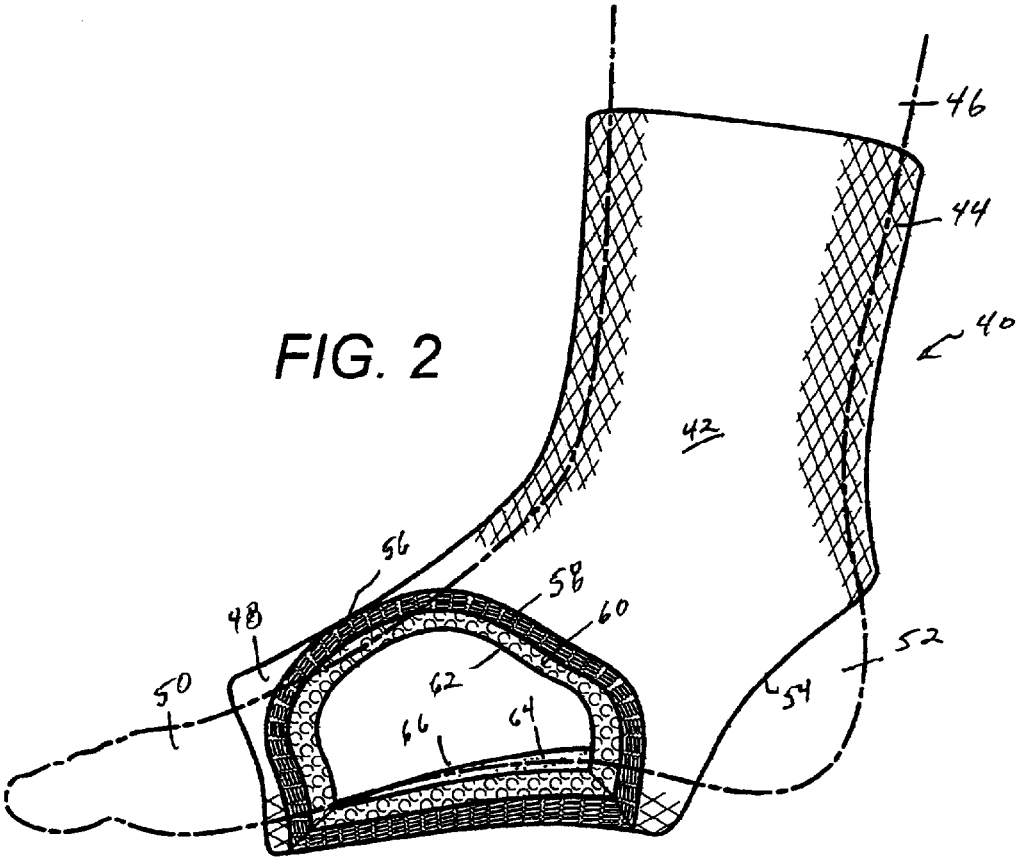
FIG. 2 is a cut-away view showing the application of the support pad of the present invention to a human ankle.

FIG. 2 shows the support padding 40 of the present invention as applied to a human ankle 42. Support padding 40 will have an interior structure similar to that of the interior structure of shoulder pad 10 of FIG. 1. In particular, ankle pad 40 has an upwardly extending ankle structure 44 extending around the ankle 42 and upwardly along a portion of the lower leg 46. A lower portion 48 of the ankle pad 40 will extend downwardly over and around the heel portion of the foot 50. Heel 52 extends outwardly of an opening 54 formed in the back portion of the ankle pad 40. The ankle pad 40 will be formed so as to be in suitable compressive relationship with the exterior surfaces of the ankle 42.

In FIG. 2, the interior surface of the ankle pad 40 is particularly illustrated. In particular, outer layer 56 is of a fibrous material generally conforming to the shape of the ankle (including the lower leg 44 and the foot portion 48). The resilient member layer 58 is positioned adjacent to the interior surface of the outer layer 56 and extends around an interior of the outer layer 56. The packing layer 60 is positioned adjacent to the resilient member layer 58 and extends around the interior of such resilient member 58. An inner layer 62 is affixed to the packing layer 60 so as to define a cavity for receiving the human ankle 42 therein. The inner layer 62 is formed of a fibrous material. Deformable members 64 are illustrated as affixed to the interior surface of the inner layer 62 adjacent to the arch 66 of the human foot 50.

Figure 3:
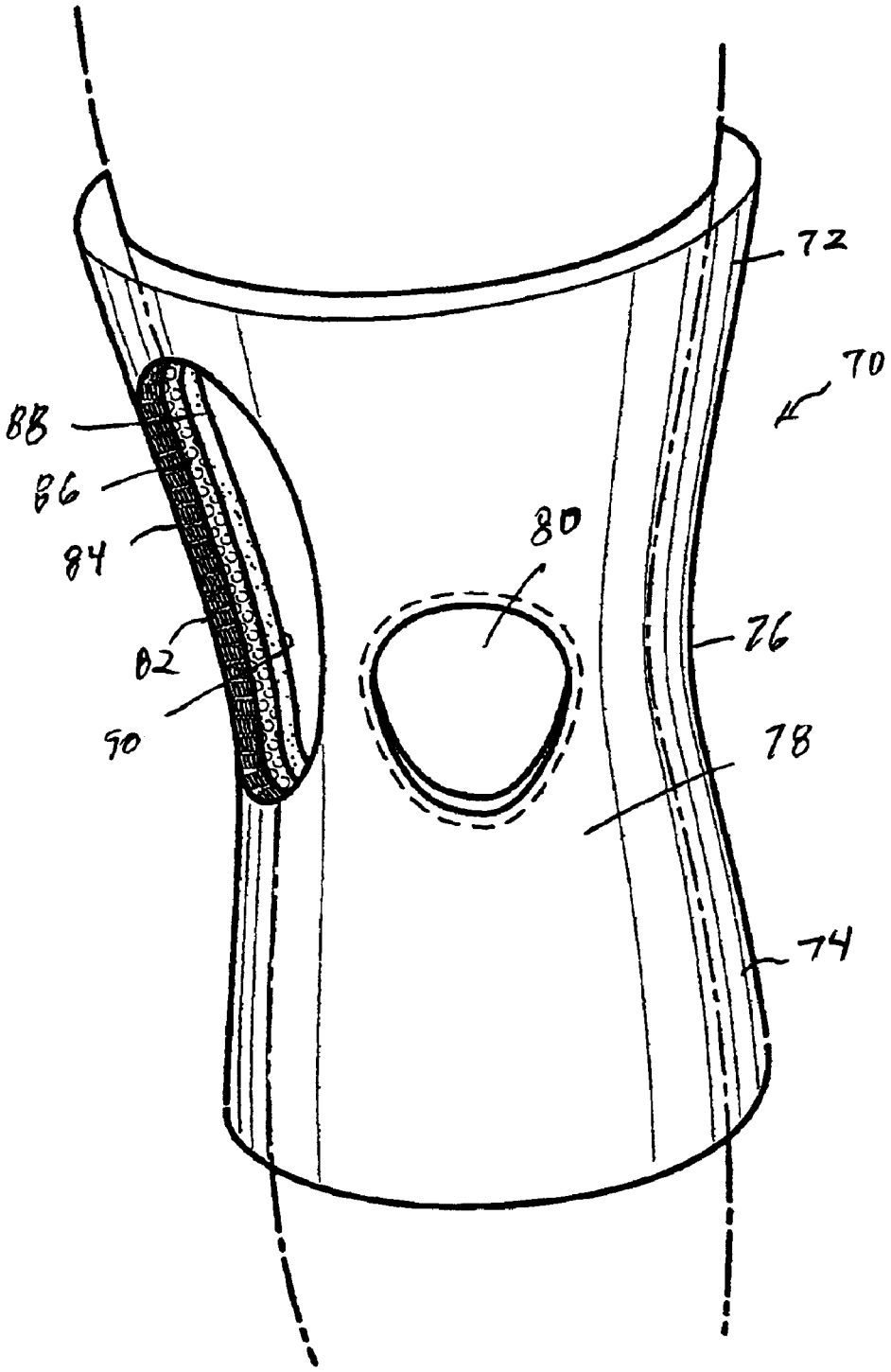
FIG. 3 is a cut-away perspective view of the support pad of the present invention as applied a human knee.

FIG. 3 shows the use of the support padding 70 in the form of a knee support. The support padding 70 includes an upper leg portion 72 and a lower leg portion 74. The central area 76 has a narrowed diameter so as to compressively fit against the surfaces of the knee 78. A hole 80 is formed through the support pad 70 so as to allow flexibility for the kneepad of the present invention.

The support pad 70 has a similar layered arrangement as the various embodiments of the present invention shown in FIGS. 1 and 2. Specifically, an outer layer 82 has a shape generally conforming to the shape of the knee joint 78 along with the upper leg portion 72 and the lowered leg portion 74. A resilient member layer 84 is positioned adjacent to the outer layer 82 and extends around an interior of the outer layer 82. A packing layer 86 is positioned adjacent to the resilient member layer 84 and extends around an interior of such resilient member layer 84. A deformable member layer 88 is affixed to an interior surface of the packing layer 86 adjacent to the surface of the human knee 78. An inner layer 90 is affixed to the deformable member layer 88. This inner layer defines a cavity for receiving the human knee 78. The inner layer 90 is formed of a fibrous material, such as cotton.

Figure 4:
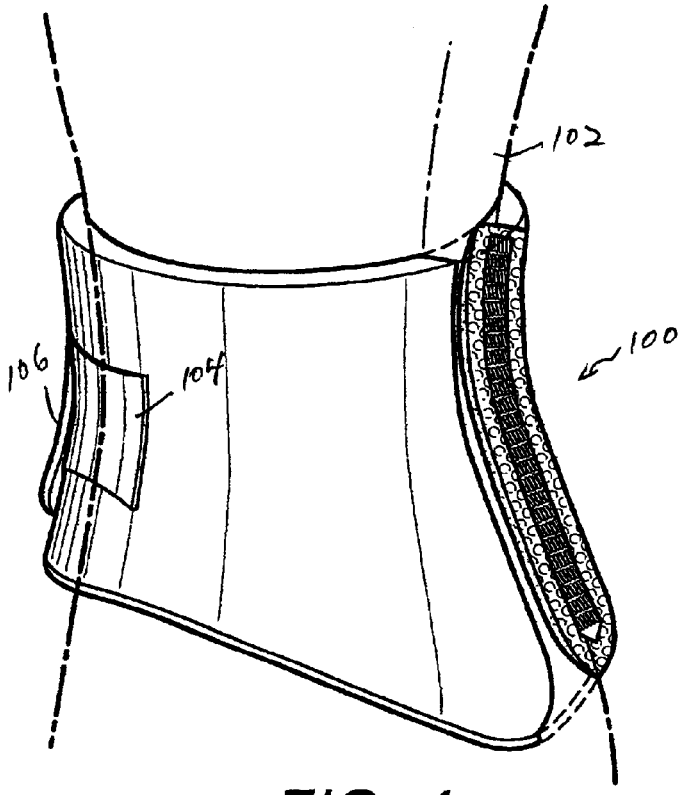
FIG. 4 is a cut-away perspective view showing the application of the support pad of the present invention to a human spine.

FIG. 4 shows the support padding of the present invention in the form of a back pad 100. The back pad 100 provides support for the human spine. Back pad 100 has a generally circular structure for extending around the waist 102 in the area of the spinal portion to be supported. The back pad 100 has a similar interior structure to that described herein previously. So as to allow the back pad 100 to be securely fitted against the spine, a closure element 104 is provided. Closure element 104 has an end secured to one edge 106 of the pad 100. A suitable VELCRO (TM) closure can be used so as to establish a secure and tight fitting of the back pad 100 against the spine. The back pad 100 will have suitable flexibility so as to allow the person wearing the back pad 100 to carry out normal activities.

Figure 5:
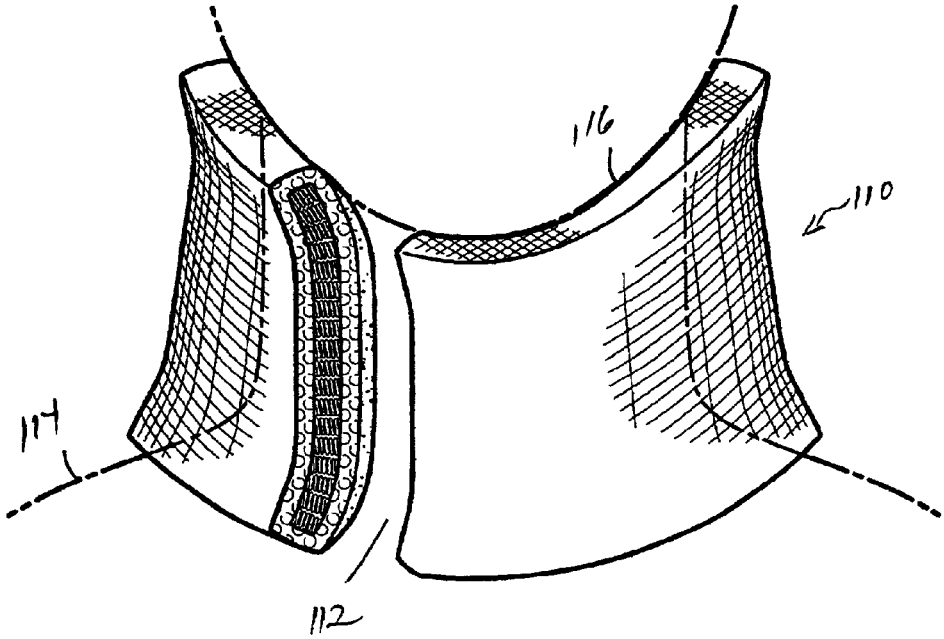
FIG. 5 is a perspective view of the support pad of the present invention to a human neck.

FIG. 5 shows the support pad of the present invention as used as a neck brace 110. The neck brace 110 has an interior structure similar to that shown in FIGS. 1–3. The neck brace 110 will extend around the human neck 112 above the shoulder 114 and below the chin 116. The neck brace 110 should have sufficient rigidity so as to provide support for the neck 112. A suitable closure element, such as that shown in FIG. 4, can be provided on the neck brace 110 so as to allow the neck brace 110 to be removed and/or secured as desired. The neck brace 110 should have a suitable compressive fit against the neck 112 so as to provide support thereto. The packing layer and the resilient member layer associated with the neck brace 110 will provide shock-absorbing characteristics so as to prevent damage to the human neck and spine in the area of the neck brace 110. These layers have been found to provide suitable flexibility so that the neck brace 110 can be used during athletic activities without impairing the performance of the user.

Figure 6:
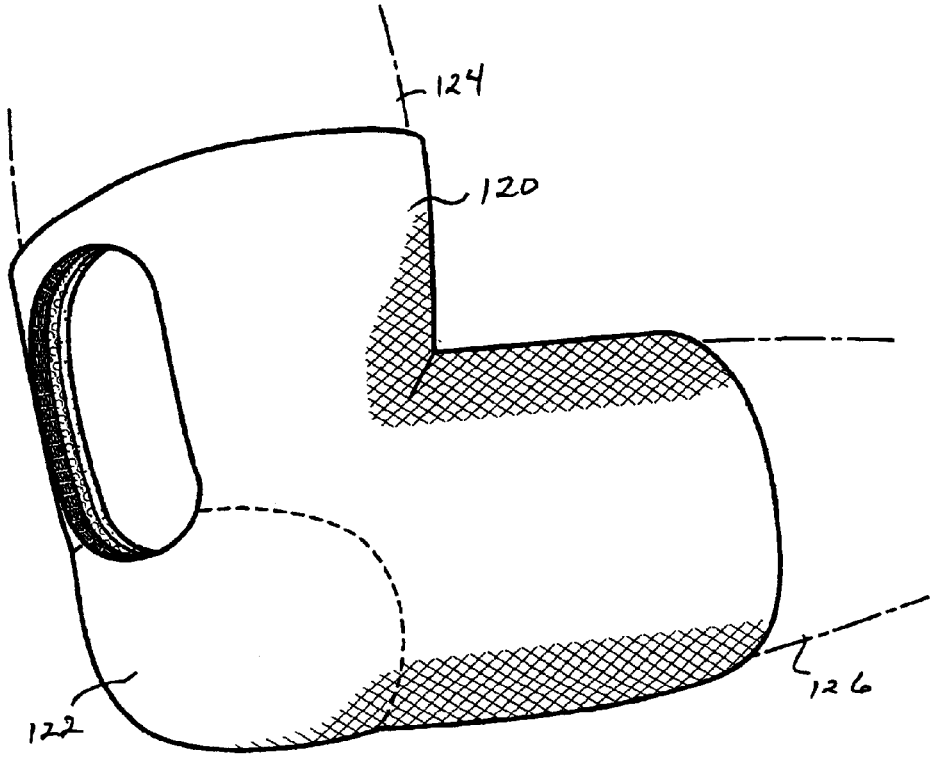
FIG. 6 is a partially cut-away view of the application of the support pad of the present invention to a human elbow.

FIG. 6 shows the support pad of the present invention as used as an elbow pad 120. The elbow pad 120 has an interior structure similar to that shown in FIGS. 1–3. The elbow pad 120 will extend around the human elbow 122 and over a portion of the upper arm 124 and a portion of the lower arm 126. The elbow pad 120 should have a suitable compressive fit over the elbow 122 so as to provide support thereto and to provide shock-absorbing characteristics.

Figure 7:
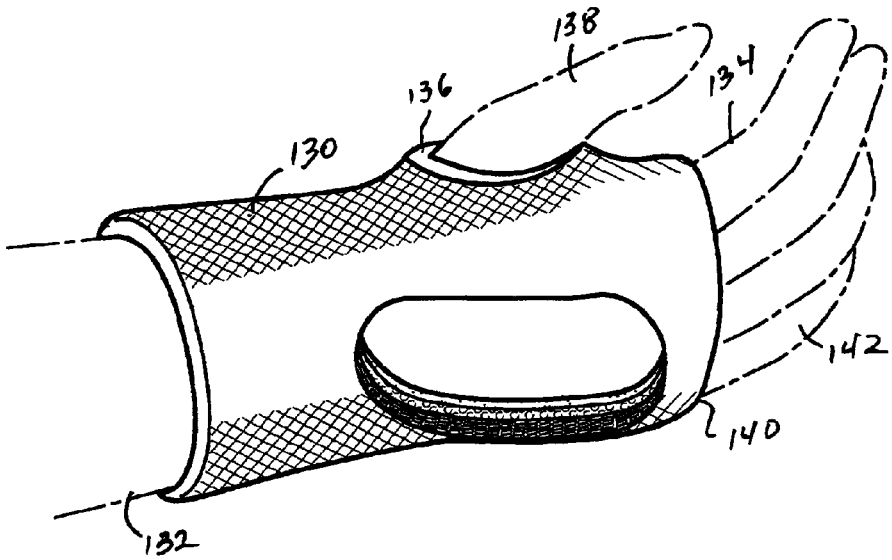
FIG. 7 is a partially cut-away view of the application of the support pad of the present invention to a human wrist.

FIG. 7 shows the support pad of the present invention as used as a wrist support 130. The wrist support 130 has an interior structure similar to that shown in FIGS. 1–3. The wrist support 130 will extend around the lower arm portion 132 and over and around the adjacent portion of hand 134. The wrist support 130 has a hole 136 through which thumb 138 extends. The wrist support 130 also has opening 140 through which fingers 142 extend. The wrist support 130 has a suitable compressive fit over the wrist so as to provide support thereto and to provide shock-absorbing characteristics.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A support padding for use on a human joint comprising:

an outer layer having a shape generally conforming to a shape of the human joint;

a resilient member layer positioned adjacent said outer layer and extending around an interior of said outer layer, said resilient member layer comprising a plurality of springs each having one end secured to said outer layer, a packing layer positioned adjacent to said resilient member layer and extending around an interior of said resilient member layer, said plurality of springs extending entirely around said packing layer; and an inner layer affixed to said packing layer, said inner layer being of a fibrous material, said inner layer defining a cavity for receiving the human joint therein.

2. The support padding of claim 1, said outer layer being of a fibrous material.

3. The support padding of claim 1, said resilient member layer comprising a plurality of springs each having one end secured to said outer layer, the support padding further comprising:

a flexible structure interposed between said packing layer and said resilient member layer, said plurality of springs each having an opposite end secured to said flexible structure.

4. The support padding of claim 1, the human joint being a knee, said outer layer having a shape conforming to an exterior surface of the knee.

5. The support padding of claim 1, the human joint being a shoulder, said outer layer having a shape conforming to an exterior surface of the shoulder.

6. The support padding of claim 5, further comprising:

a strap extending in a loop outwardly of said outer layer, said strap having a size suitable for extending around a human torso.

7. The support padding of claim 1, said human joint being an ankle, said outer layer having a shape conforming to an exterior surface of the ankle.

8. The support padding of claim 1, said human joint being an elbow, said outer layer having a shape conforming to an exterior surface of the elbow.

9. The support padding of claim 8, said outer layer, said resilient member layer, said packing layer, and said inner layer being generally elastic so as to extend around the elbow in generally compressive relationship therewith.

10. The support padding of claim 1, said human joint being a spine, said outer layer having a shape conforming to an exterior surface of the human body in the area of the spine.

11. The support padding of claim 10, further comprising:

a closure means affixed adjacent to an edge of said layers, said closure means for releasably securing said layers around the human body adjacent to said spine.

12. The support padding of claim 1, the human joint being a neck, said outer layer having a shape conforming to an exterior surface of the neck.

13. A support padding for use on a human joint comprising:

an outer layer having a shape generally conforming to a shape of the human joint;

a resilient member layer positioned adjacent said outer layer and extending around an interior of said outer layer;

a packing layer positioned adjacent to said resilient member layer and extending around an interior of said resilient member layer, said packing layer being a material selected from the group consisting of said bubble wrap material and foam material; and an inner layer affixed to said packing layer, said inner layer being of a fibrous material, said inner layer defining a cavity for receiving the human joint therein.

14. The support padding of claim 13, said outer layer being of a fibrous material.

15. The support padding of claim 13, said resilient member layer comprising a plurality of spring each having one end secured to said outer layer, the support padding further comprising:

a flexible structure interposed between said packing layer and said resilient member layer, said plurality of springs each having an opposite end secured to said flexible structure.

16. The support padding of claim 13, further comprising:

a deformable member means affixed to said packing layer opposite said resilient member layer, said deformable member means for conforming to a contour of the human joint upon pressure applied by a surface of the human joint thereto.

17. The support padding of claim 16, said deformable member means comprising:

a plurality of silicone pads affixed to an interior surface of said packing layer.

18. The support padding of claim 17, said inner layer affixed to said deformable member means.

19. A support padding for a human joint comprising:

an outer layer having a shape generally conforming to a shape of the human joint;

a resilient member layer positioned adjacent said outer layer and extending around an interior of said outer layer;

a packing layer positioned adjacent to said resilient member layer and extending around an interior of said resilient member layer;

a deformable member means affixed to said packing layer opposite said resilient member layer, said deformable member means for conforming to a contour of the human joint upon pressure applied by a surface of the human joint thereto; and an inner layer affixed to said deformable member means, and to said packing means, said inner layer being of a fibrous material, said inner layer defining a cavity for receiving the human joint therein.

20. The support padding of claim 19, the human joint selected from the group consisting of a shoulder, an ankle, a knee, a spine, a neck, an elbow and a wrist, said inner layer having an inner diameter suitable for residing in compressive relationship against the human joint.

* * * * *